US005443011A

United States Patent [19]

Coates et al.

[11] Patent Number: 5,443,011

[45] Date of Patent: Aug. 22, 1995

[54] TECHNIQUE FOR INDUCING SUBCALIBER PROJECTILE YAW

[75] Inventors: Randolph S. Coates, Havre de Grace; William R. Edmanson, Jr., North East, both of Md.

[73] Assignee: The United States of America as represented by the Secretary of the Army, Washington, D.C.

[21] Appl. No.: 305,234

[22] Filed: Sep. 13, 1994

[51] Int. Cl.[6] ..... F42B 14/06

[52] U.S. Cl. ..... 102/522; 102/293; 244/31

[58] Field of Search ..... 102/293, 498, 520–523, 102/529; 244/3.1

[56] References Cited

U.S. PATENT DOCUMENTS 4,590,862 5/1986 Grabarek et al. ..... 102/522

*Primary Examiner*—Harold J. Tudor

*Attorney, Agent, or Firm*—Freda L. Krosnick; Muzio B. Roberto

[57] ABSTRACT

A gun launched projectile design which imparts forces to a subcaliber projectile comprising: a subprojectile, a multi petal sabot, a pusher plate, and an obturator. The petals are of different length and have a scooped-out design on the face thereof, so as to induce a specific level of yaw to the projectile.

6 Claims, 6 Drawing Sheets

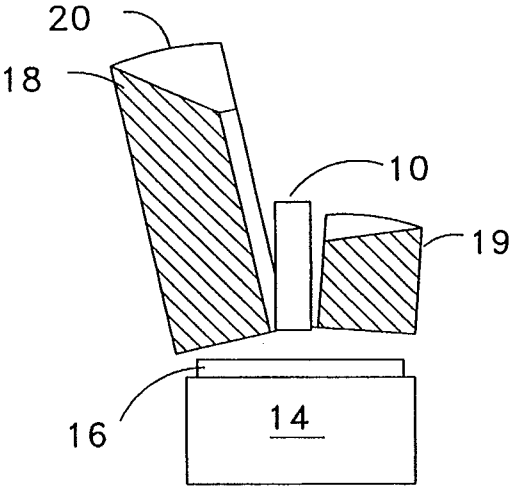
FIG. 3 (a)
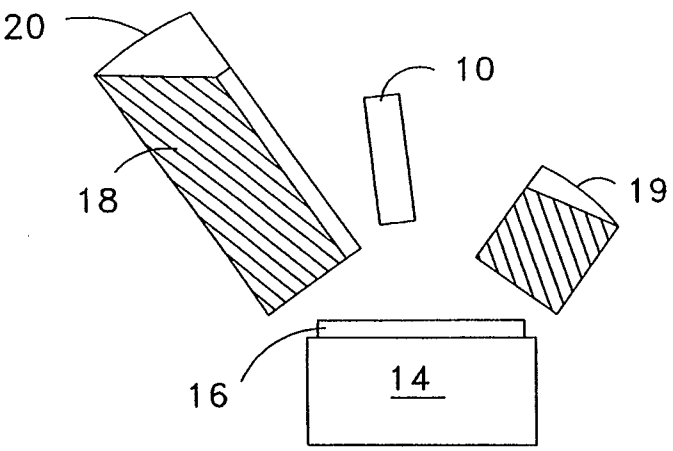
FIG. 3 (c)
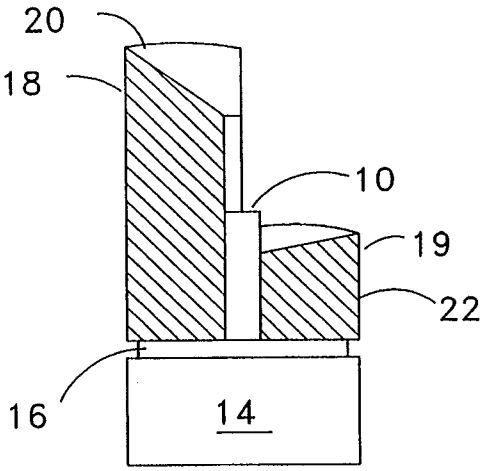
FIG. 3
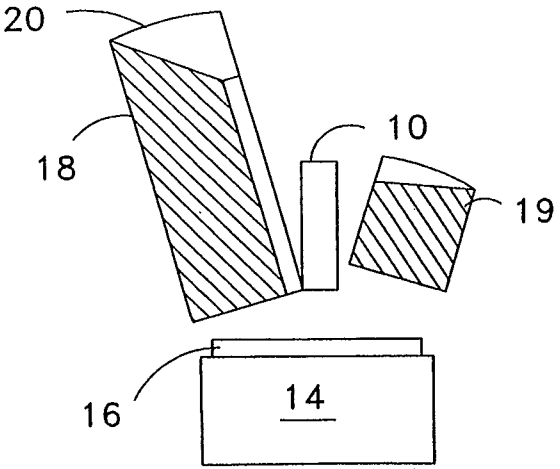
FIG. 3 (b)'

TECHNIQUE FOR INDUCING SUBCALIBER PROJECTILE YAW

RIGHTS OF THE GOVERNMENT

The invention described herein may be manufactured, used, and licensed by or for the Government for Governmental purposes without payment to us.

BACKGROUND OF INVENTION

1. Field of Invention

This invention relates to a gun launched projectile design which imparts force to a subcaliber projectile, so as to induce a specific level of yaw.

2. Description of Related Art:

A variety of projectile design options exist in the art that provide a means for gun launching objects whose cross-sectional area or shape disallows the use of an integral obturator seal, e.g. an object whose effective diameter is less than the bore diameter of the launcher. Techniques vary depending on the intended application, different techniques are used for laboratory research and for weaponized ammunition. One laboratory launch method is known as the push- launch technique.

A typical prior art push-launch projectile comprises a subprojectile, multi-piece sabot petals, pusher plate, and and obturator. The subprojectile is the test item. Typical subprojectiles are rod penetrators or aero-ballistic flight bodies. The multi-piece sabot petals are composed of a multiplicity of petals which provide lateral support and alignment for subprojectile while in in-bore. Once the projectile exits the muzzle, the sabot petals separate. The usual goal during sabot petal discard is to impart minimal disturbance to the subprojectile that could alter its trajectory or induce yaw.

Yaw is defined as the angle between the long axis of the subprojectile and the line defined by the trajectory of the center of gravity of the subprojectile. Yaw is usually broken into two components, a vertical pitch and horizontal yaw which are measured in an earth -based laboratory coordinate system..The pusher plate supports the subprojectile and sabot during in-bore acceleration. The obturator serves as a seal for the propellant gases and transfers pressure to the pusher plate. The items are not fastened to the sabot or subprojectile and on muzzle exit, separate due to their higher aerodynamic drag.

Upon exit from the gun muzzle, stagnation conditions are reached on the leading surface of the sabot upon which are machined conical sections giving a scoop shaped surface. The scoop surface is designed in such a way that the resulting air pressure induces a moment which causes the petals to lift from the front, pivoting on the subprojectile at the aft end. During this time the sabot petals are in contact with the subprojectile and thus can apply a mechanical load at the aft end of the subprojectile. Aerodynamic loads can also be applied to the subprojectile during the sabot discard process. Supersonic flow around the subprojectile create shock waves which impinge on the subprojectile, which in turn can lead to subprojectile disturbance.

Prior art sabot petals have been designed to have identical geometric and aerodynamic configuration. Thus any load induced by a discarding sabot petal is counteracted by the opposing sabot petal. This provides the best chance of low flight disturbance, which is the clear goal of the prior art.

SUMMARY OF THE INVENTION

This invention relates to a method and system which imparts force to a subcaliber projectile so as to introduce a specific level of yaw useful in the investigation of exterior and terminal ballistic phenomena.

Ballistic behavior under conditions where the long axis of the subprojectile is not aligned with the trajectory of the center of gravity, i.e., a yawed subprojectile, is important. In some applications, effects related to yaw may dominate behavior of interest. In the field of aerodynamics, high yaw may cause poor projectile accuracy and may lead to flight body structural problems. Terminal ballisticians have noted the reduction in rod penetration performance for conditions of high impact yaw. In order to evaluate these effects in laboratory research and development programs, techniques are needed that can induce yaw. To perform research effectively requires the ability to control yaw in a systematic fashion.

OBJECTS OF THE INVENTION

It is an object of the present invention to disclose a system for inducing yaw in subcaliber projectiles in order to facilitate research in exterior and terminal ballistic phenomena.

It is a further object of the present invention to induce and vary yaw systemically by applying large and unbalanced forces at the base of subprojectile.

Other objects and a fuller understanding of the invention may be ascertained from the following description and claim

BRIEF DESCRIPTION OF THE DRAWINGS

FIG. 3, 3 (*a*) , 3 (*b*) , and 3 (*c*) is a cross-sectional view illustration of the separation of sabot petals during the firing of the projectile.

DESCRIPTION OF PREFERRED EMBODIMENT

Figure 1:
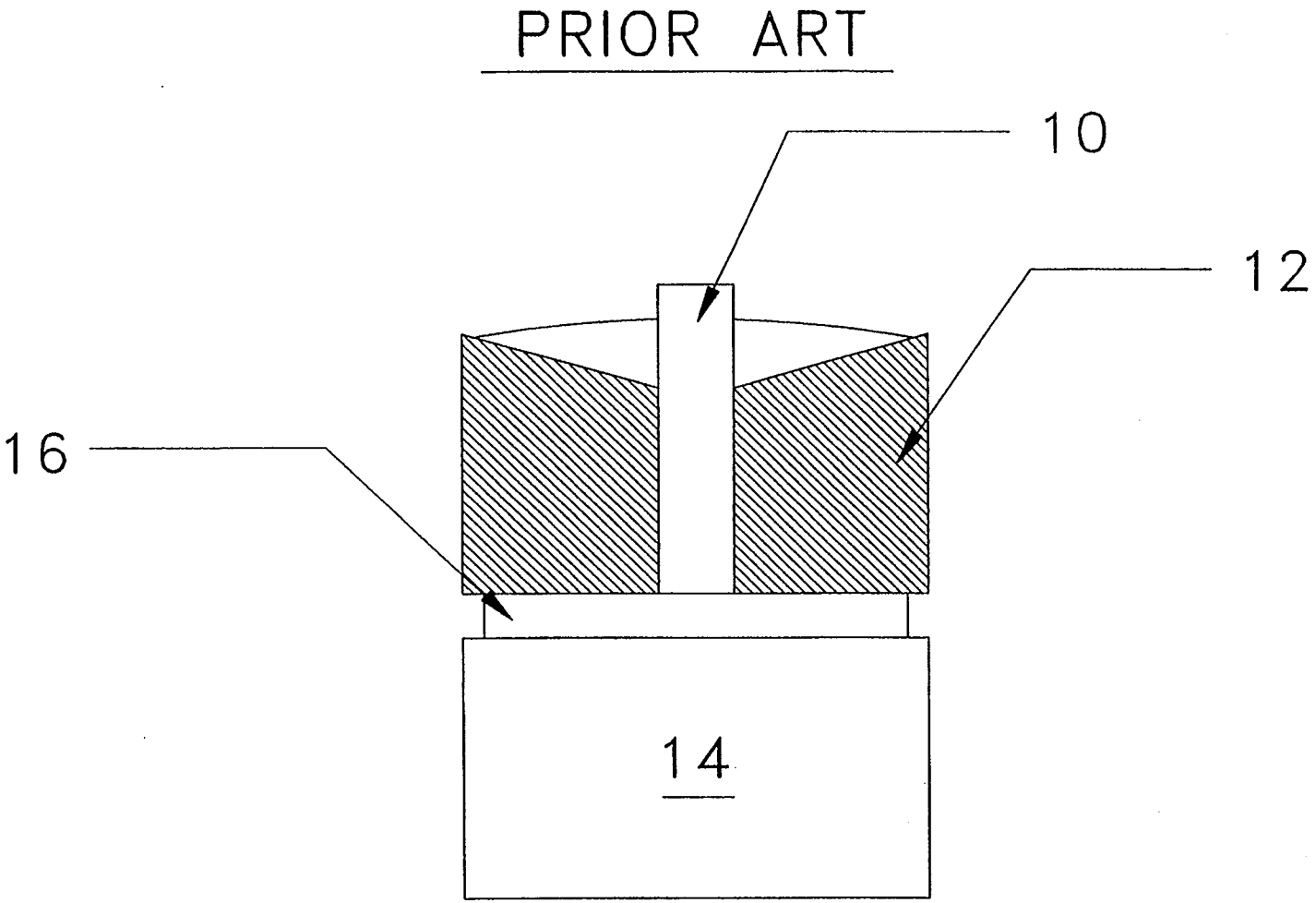
FIG. 1 is a cross-sectional view illustration of a typical prior art push-launch projectile.

FIG. 1 is a schematic illustration of a push- launch projectile currently in use. The system comprises subprojectile subprojectile 10, multi petals 12, pusher plate 16, and obturator 14.

Figure 2:
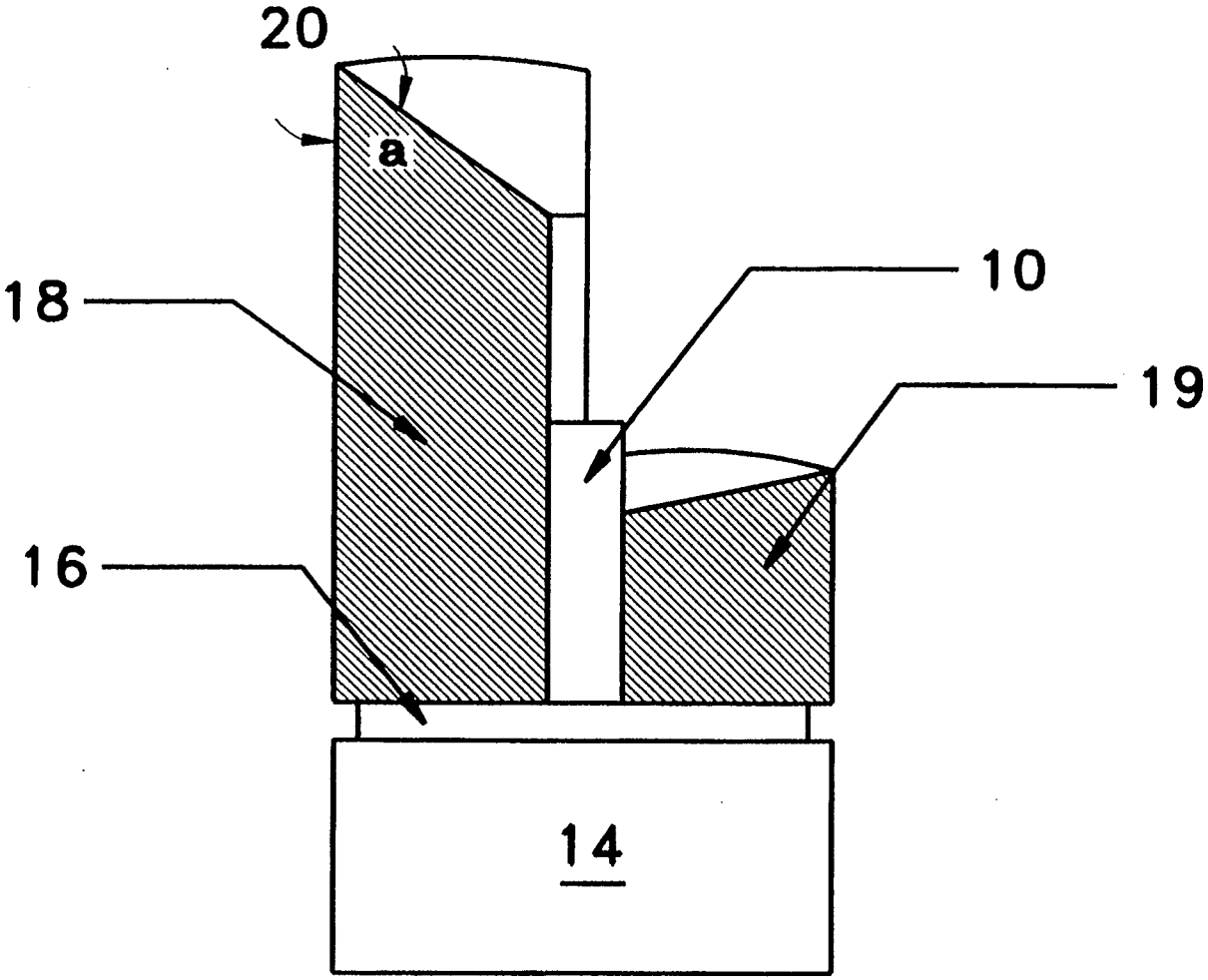
FIG. 2 is a cross-sectional view illustration of the present invention

Referring to FIG. 2 of the drawing, there is shown a schematic of the system of the present invention. The system comprises a subprojectile 10, multi sabot petals 18 and 19, pusher plate 16, and obturator 14. Sabot petals 18 and 19 are of different lengths. Two to six sabot petals may be utilized. In addition, the leading edges of the sabot petals comprise a conical scooped-configuration 20 of about 30 to 60 degrees, which influences the initial discard behavior.

Therefore, greater mechanical force will be applied to one side of the subprojectile, imparting an initial yaw to the subprojectile. Reference is made to FIG. 3 which shows the system in a stationary position. As the projectile exits the muzzle, the difference in petal mass and lift characteristics will begin to influence the subprojectile. Short sabot petal 19 having less mass, separates faster than long sabot petal 18. Thus it disengages from the subprojectile sooner, as shown in FIGS. 3, 3 (*a*), 3(*b*) and 3(*c*). After sabot petal 19 disengages, FIG. 3 (*b*) sabot petal 18 remains in contact with the subprojectile and continues to apply force thereto which is not balanced by an opposing force. The magnitude of the initial yaw is controlled by tailoring the difference in the impulse applied by each sabot petal, which is controlled in turn by their respective mass and lift.

The orientation of the subprojectile is controlled by the placement of the projectile in the gun. For Example, if only pitch is desired, the projectile should be placed in the gun such that the sabot petal interface is horizontal. Upward pitch is achieved by placing long sabot petal 18 above the short sabot petal, while the exact opposite configuration is used to achieve a downward pitch. Any combination of pitch and yaw can be achieved by properly orienting the projectile. This concept has been tested as will be described herein after.

Figure 4:
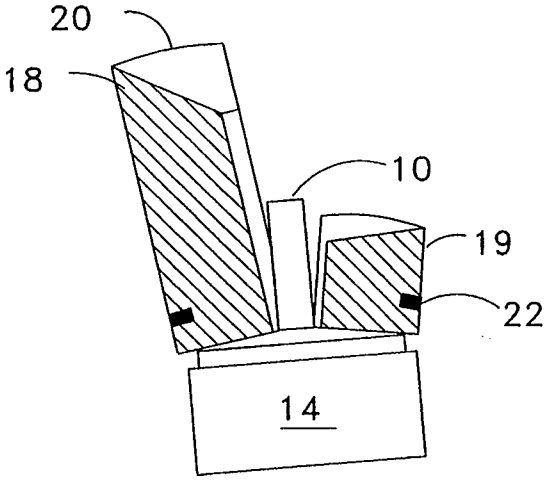
FIG. 4, 4 (*a*) , 4 (*b*) , and 4 (*c*) is a cross-sectional illustration of an alternative of the invention of FIG. 3.
Figure 4:
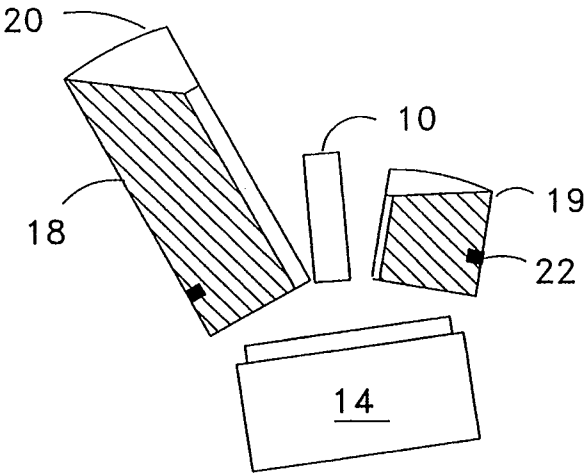
Figure 4:
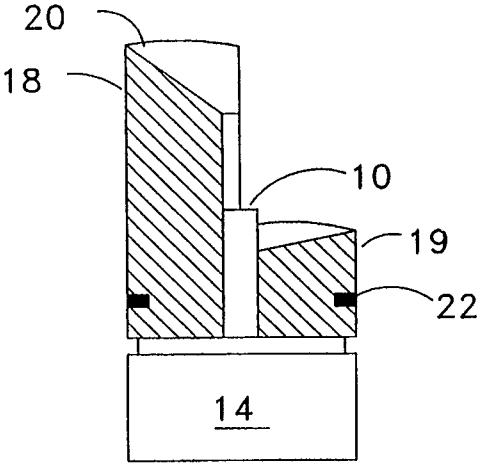
Figure 4:
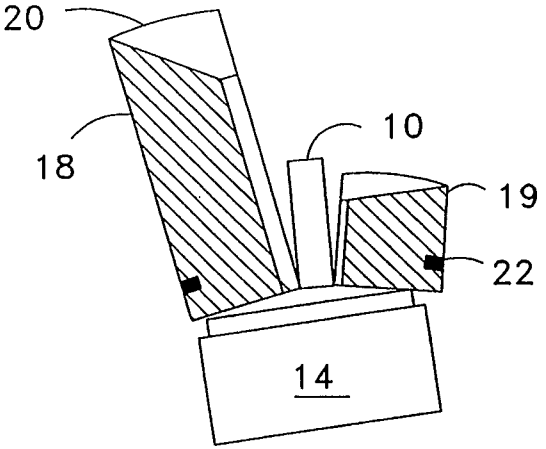

An alternative is disclosed in FIG. 4. comprising means for retarding sabot petal discard or separation. This is accomplished by machining a groove circumferential to the aft end of the sabot petals 18 and 19. Band 22 is inserted in the machined groove. The band may be constructed of any suitable material such as metal or plastic. The band offers resistance to the sabot discard in that it prevents separation of the aft end of the sabot petals from the subprojectile until such time the stress on the band reaches a preset breaking strength. Prior to this time, the difference in lift between the two sabot petals results in application of a moment to the subprojectile. The entire projectile will yaw in accordance with the applied moment . Further yawing will be achieved during the sabot discard process. This is because long sabot petal 18 will maintain contact with the subprojectile and maintain an impulsive force. The combined effect leads to greater yaw magnitude.

Another alternative by which yaw magnitude and precision can be achieved is by coating the interface between the subprojectile and the sabot petals with an adhesive material, not shown. This will have the effect of the "hold down" (band) device, i.e., there will be an increase in time during which force can be applied by sabot petal 18 to the subprojectile. Since no adhesive would be applied to the interface between sabot petal 19, and the subprojectile, there is more rapid decoupling of the subprojectile from that petal.

Figure 5:
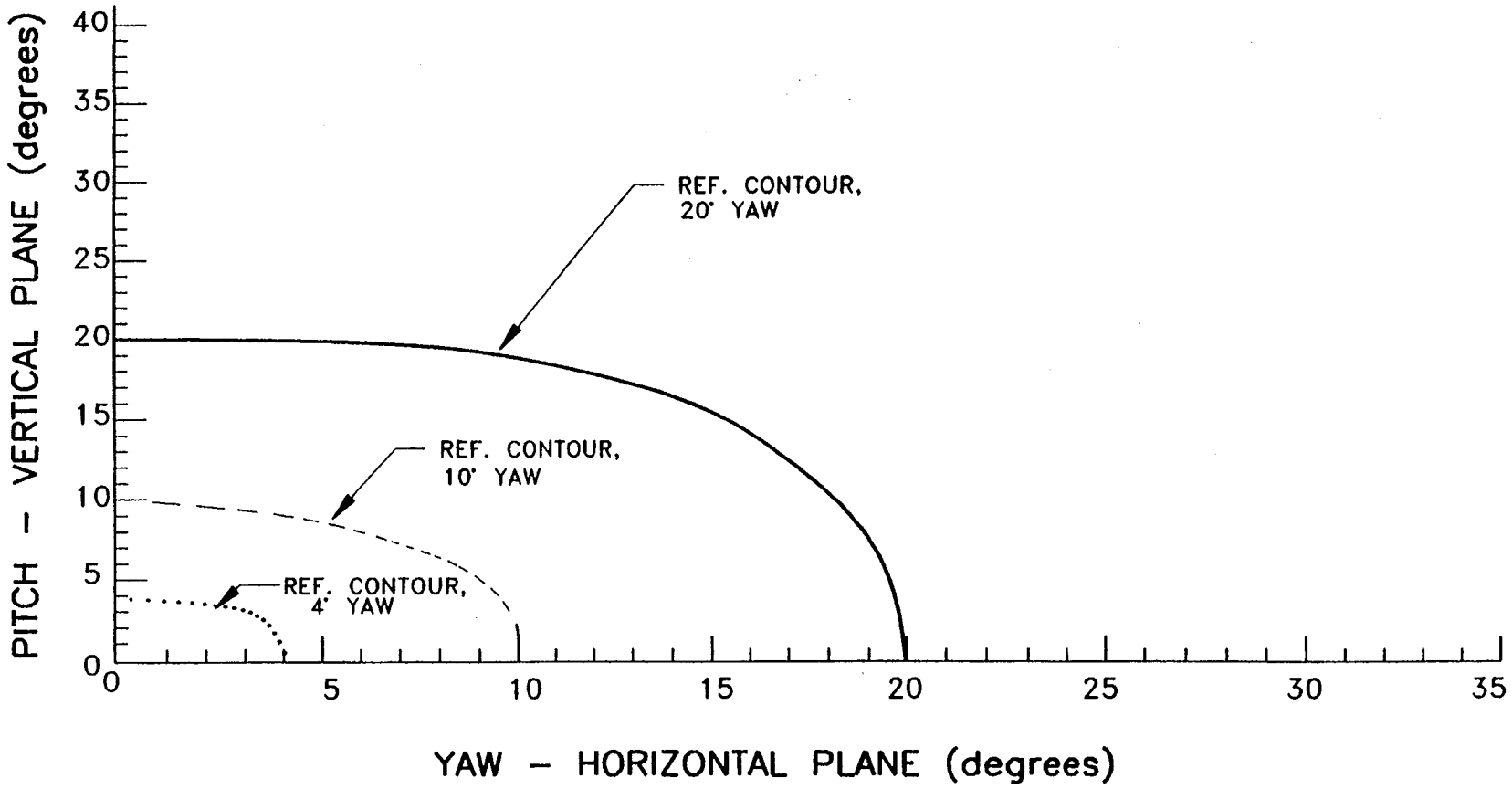
FIG. 5 is a graph showing the pitch end yaw (degrees) of various saboted projectiles with the present invention.

FIG. 5 is a graph comparing subprojectile yaw and pitch data of prior art Push-Launch laboratory projectiles of FIG. 1 with the system of FIG. 2. The total projectile yaw is measured in two orthogonal planes, i.e., a vertical pitch component and a horizontal yaw component.

A 4 degree reference contour was obtained using the prior art system of FIG. 1, whereas a 10 degree reference contour was obtained using the present invention of FIG. 2. Further, while prior art projectiles produce random combinations of yaw and pitch, the invention demonstrates the ability to very nearly produce only one component of total yaw, in this case, the pitch component.

Figure 6:
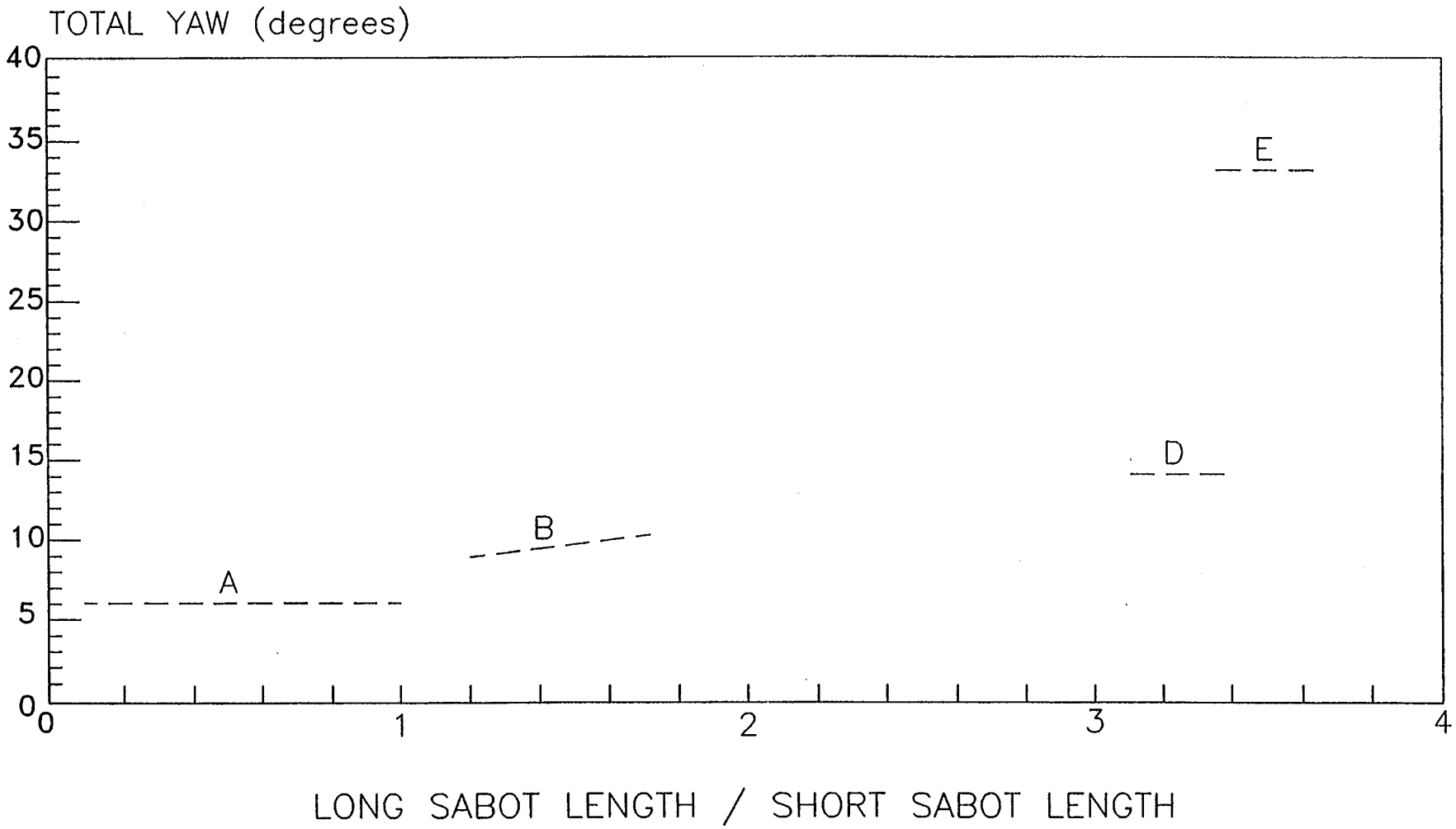
FIG. 6 is a graph showing a comparison of yaw (degrees) of a conventional projectile with the present invention

FIG. 6. is a graphic illustration of the effects on yaw caused by varying the lengths of the petals and scoop configuration on face thereof. In the graph:

1. "A" illustrates a conventional projectile having symmetric sabot petals.
2. "B" represents an aspect of subject invention wherein the sabot petals are of different lengths, with the long sabot petals having a scoop of 45 degrees and the short sabot petals having a sabot scoop of 60 degrees.
3. "D" represents aspect of the invention wherein the sabot petals are of different lengths, with the long sabot petals having a scope of 40 degrees, and the short petal having a scoop of 60 degrees.
4. "E" represents aspect of the invention wherein the sabot petals are of different lengths, with the long sabot petal having a scoop of 30 degrees, the short sabot petals having a scoop of 60 degrees, and the interface between the subprojectile and the sabot petal coated with an adhesive.

Prior art subprojectiles, as illustrated by FIG. 1, had a total yaw (degrees) of about 5, whereas, designs of the present invention had total yaws of about 10 to 15 degrees, with a maximum of about 35 degrees as demonstrated.

While there has been described what is presently considered to be the preferred embodiment of the invention, it will be obvious to those skilled in the art that various changes and modifications may be made therein without departing from the invention, whose scope is limited only by the following claims.

Having described our invention, we claim:

1. A saboted projectile comprising;

a subcaliber projectile a sabot means for achievement of axial alignment of the projectile and for providing lateral in-bore support, and for applying an unbalance force to the projectile and for the purpose of inducing a projectile yaw, said sabot means possessing a plurality of pedals having different length whose design, mass and lift are tailored to achieve a specific level impulse that will provide a predetermined level of subprojectile yaw, pusher plate means for supporting the subprojectile and sabot during in-bore acceleration, and obturator means for providing a seal to the high pressure propellant gases and for supporting the pusher plate.

2. A saboted projective in accordance with claim 1 wherein the sabot means comprise a plurality of pedals having different weights.

3. A saboted projective in accordance with claim 1, wherein a leading surface of the sabot means comprises a machined aonical section giving a scoop shaped surface.

4. A saboted projectile in accordance with claim 1, wherein the sabot means comprise a recessed annular groove positioned at an aft end therof.

5. A saboted projective in accordance with claim 4 comprising retaining ring means, positioned in the annular groove and designed to fail at a predetermined load.

6. A saboted projective in accordance with claim 1, wherein the petals are secured by a band 22 positioned around the periphery of the petals.

* * * * *